United States Patent [19]

Meiller et al.

[11] 4,153,294

[45] May 8, 1979

[54] APPARATUS FOR ADJUSTING THE INCLINATION OF SEAT UPHOLSTERY IN A DRIVER'S SEAT, OFFICE CHAIR, REVOLVING ARMCHAIR OR THE LIKE

[75] Inventors: Hermann Meiller, Amberg; Otto Kunst, Michael-Poppenricht, both of Fed. Rep. of Germany

[73] Assignee: Messrs. Willibald Grammer, Fed. Rep. of Germany

[21] Appl. No.: 848,037

[22] Filed: Nov. 3, 1977

[30] Foreign Application Priority Data

Aug. 13, 1977 [DE] Fed. Rep. of Germany ..... 2736550

[51] Int. Cl.[2] ..... A47C 7/02

[52] U.S. Cl. ..... 297/284; 297/458

[58] Field of Search ..... 297/284, 313, 337, 338, 297/339, 458; 248/397, 396

[56] References Cited

U.S. PATENT DOCUMENTS

| | | | |
|---|---|---|---|
| 2,756,809 | 7/1956 | Endresen | 297/284 |
| 3,405,900 | 10/1968 | Robinson | 248/396 |
| 3,948,558 | 4/1976 | Obermeier | 297/284 |
| 4,018,477 | 4/1977 | Hogan | 297/284 |

FOREIGN PATENT DOCUMENTS

| | | | |
|---|---|---|---|
| 1560098 | 2/1969 | France | 248/396 |
| 530315 | 12/1940 | United Kingdom | 248/397 |
| 1199756 | 7/1970 | United Kingdom | 297/284 |

*Primary Examiner*—Francis K. Zugel

*Attorney, Agent, or Firm*—Staas & Halsey

[57] ABSTRACT

A seat comprising upholstery on a base plate is provided with means for adjusting the height of the upholstery surface at least at the front of the seat, said adjusting means comprising an intermediate plate interposed between the upholstery and the base plate to define with the base plate a tapered gap. The intermediate plate is pivoted to the base plate about a transverse axis and rests on a displaceable supporting member disposed in the gap at a selected spacing from the transverse axis. To adjust the height of the upholstery, the supporting member is moved further towards or away from the transverse axis.

12 Claims, 2 Drawing Figures

Fig. 1

APPARATUS FOR ADJUSTING THE INCLINATION OF SEAT UPHOLSTERY IN A DRIVER'S SEAT, OFFICE CHAIR, REVOLVING ARMCHAIR OR THE LIKE

BACKGROUND OF THE INVENTION

The invention relates to an apparatus for adjusting the inclination of seat upholstery arranged on a supporting plate for a driver's seat, office chair, revolving armchair or the like.

Particularly for driver's seats for heavy motor vehicles such as lorries, coaches and buses, but also in the case of seating furniture in the higher price group, especially office chairs or revolving armchairs, there is an endeavour to make it possible for the user of the seat to adapt it to his personal requirements by providing a wide range of possible adjustments so that he may find it easier to use the seat for prolonged periods. Amongst these possibilities of adjustment there is included the adjustability of the inclination of the seat upholstery. In the case of driver's seats, one can in this way improve the support given to the user's thigh so as to retard the oncoming of tiredness.

Apparatuses hitherto provided for adjusting the inclination of seat upholstery have without exception been installed beyond the confines of the supporting plate for the upholstery and have been fairly complicated. For this reason, the user will in most cases forego the accepted advantage of the adjustability of the inclination of the upholstery.

For revolving armchairs it is already known to have an articulated connection between the supporting plate for the seat upholstery and the frame of the seat so as to make it possible to change the inclination of the supporting plate relatively to the frame by means of a hand wheel or the like. This apparatus for adjusting the inclination is, however, unsuitable for driver's seats because of its inadequate stability.

SUMMARY OF THE INVENTION

It is an object of the present invention to provide an apparatus of the aforementioned kind which is applicable not only to driver's seats but also to other seating furniture, is strong and stable in its construction but to all intents and purposes does not increase the overall size of the seat.

According to the invention, at least the front region of the seat upholstery rests on an intermediate plate which is mounted on the supporting plate for pivoting about a transverse axis, includes an angle with the supporting plate to define a wedge-shaped gap with increasing height towards the front of the seat upholstery, and rests on a carrier that is mounted on the supporting plate at a variable spacing from the transverse axis and at a substantially constant spacing from the supporting plate.

According to the invention, therefore, at least that portion of the seat upholstery adjoining the front edge does not rest directly on the supporting plate as was the case with known seats but on an intermediate plate of which the inclination is adjustable by appropriately changing the spacing of its supporting carrier from the transverse axis. When the carrier is located near the transverse axis, the angle between the intermediate plate and the supporting plate is relatively large, whereas the angle becomes smaller the further the carrier is removed from the transverse axis. In this way one obtains a very simply constructed but extremely robust inclination adjustment apparatus which also has the advantage that, with the exception of the actuating member for the carrier, it can be disposed entirely within the confines of the supporting plate receiving the seat upholstery. Further, the accommodation of the intermediate plate with the adjusting mechanism for the carrier normally presents no difficulties because in most seats the seating portion is in any case thicker adjacent the front edge than it is nearer the backrest even though the load applied near the front edge is less and the seat upholstery could therefore be thinner in this region. The apparatus of the present invention in this respect provides the additional advantage of making it possible to dispense with excess upholstery. The carrier for supporting the intermediate plate can simply be in the form of a transverse rod.

The carrier is preferably set in a fixed position relatively to the transverse axis of the intermediate plate in that the carrier is secured to a nut seated on a screw-threaded spindle which extends perpendicular to the transverse axis, carries an actuating member and is rotatably mounted on the supporting plate but axially undisplaceable. Desirably, the spindle is freely rotatably mounted in lengths of tube secured to the supporting plate at the ends of the required displacement path for the nut and is locked against axial displacement by means of lock washers. The mechanism for moving the carrier therefore consists primarily of two parts, namely the screw-threaded spindle and the nut.

To make it possible to dispense with reversible gearing or the like, the invention further provides for the screw to project beyond the front edge of the supporting plate and there to carry a hand wheel as the actuating member. If the hand wheel is located substantially at the middle of the seat, it will therefore not normally present an obstruction.

According to another aspect of the invention, the intermediate plate is provided with at least one angle member which projects beyond the rear edge and comprises a first limb extending substantially as a prolongation of the intermediate plate adjacent the supporting plate and a second limb extending from the first limb away from the supporting plate. The at least one angle member has a width less than that of the intermediate plate and is so inserted at the rear edge in a transverse slot of a cross-member mounted on the supporting plate substantially parallel to the second limb that the first limb passes through the transverse slot and the second limb is disposed on the side of the cross-member remote from the intermediate plate. This construction of the intermediate plate in conjunction with the slotted cross-member has the advantage that practically no additional pivoting components, hinges or the like are required, whereby the construction is extremely simple. Further, mounting of the intermediate plate presents no difficulties because the angle members need merely be pushed into the transverse slots of the cross-member before the seat upholstery is applied, and yet the intermediate plate is reliably pivotally mounted and nevertheless undisplaceably held to the supporting plate.

It is advantageous in the aforementioned construction for the intermediate plate to possess two spaced angle members adjoining the side edges of the intermediate plate because unintentional pivoting of the intermediate plate is then reliably avoided.

The angle members can be applied in a particularly simple manner if the angle member or the plurality of angle members is/are formed on the intermediate plate.

In a particularly simple construction, the cross-member is formed by one limb of an angle section secured to the supporting plate by its other limb. The second limb that is not provided with transverse slots can be fixed to the supporting plate in an absolutely reliable manner, for example by means of screws or welding.

A particularly good support for the seat upholstery is obtained if the intermediate plate comprises a front section which adjoins the front edge of the intermediate plate and is substantially parallel to the supporting plate when the smallest inclination is set, as well as a middle section which adjoins the front section and extends obliquely towards the transverse axis and the supporting plate, the middle section of the intermediate plate preferably being adjoined by an end section which extends substantially parallel to the front section and in the region of which the transverse axis is provided. This double-flanged construction of the intermediate plate also helps to increase its stability. In addition, one has the advantage that the section of the intermediate plate to a large extent follows the usual profile at the top of the seat upholstery, whereby the thickness of the upholstery can be substantially constant along the entire intermediate plate.

Finally, it is within the scope of the invention for the intermediate plate, carrier and adjusting means for the carrier to be accommodated in a recess in the underside of the seat upholstery so that the supporting plate covering the underside of the seat may be planar.

Further features, details and advantages of the invention will become evident from the following description of a preferred example illustrated in the accompanying drawings, which are very much diagrammatic and wherein:

DESCRIPTION OF THE PREFERRED EMBODIMENT

Figure 1:
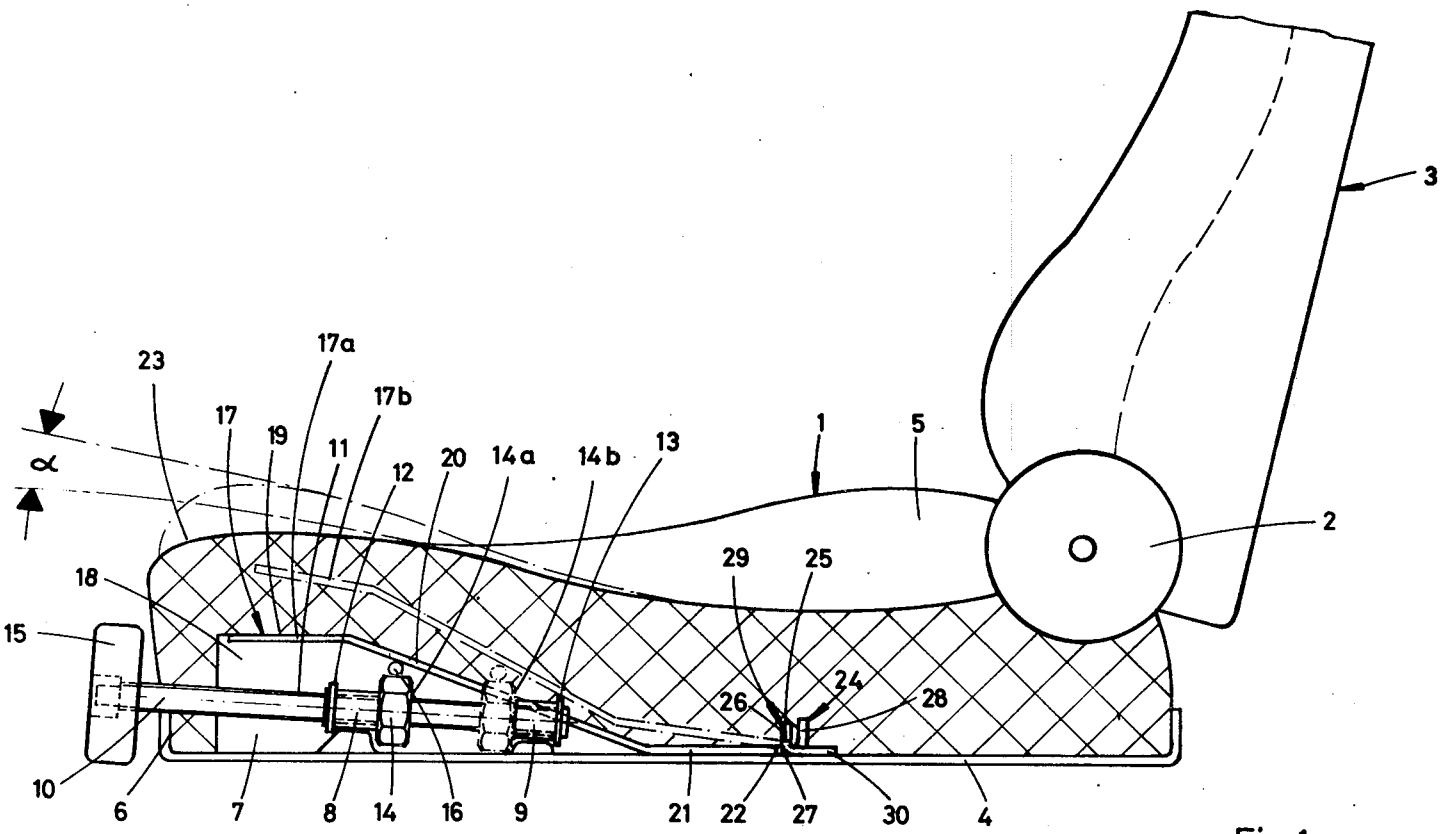
FIG. 1 is a vertical section through the seating surface of a driver's seat equipped with the apparatus according to the invention.

The driver's seat shown in FIG. 1 comprises a seating portion 1 to which a backrest 3 is secured with an adjustable inclination by means of a conventional hinge fitting 2.

The seating portion 1 comprises a supporting plate 4 which can be fixed in any known manner to a base (not shown), for example a scissor frame or a column. The supporting plate 4 is covered at the top by upholstery 5 which is shaped to conform to the shape of the body.

As is particularly evident from FIG. 1, the seat upholstery 5 has a recess 7 at the underside in the region adjoining its front edge 6, the recess serving to receive the apparatus for adjusting the inclination of the seat upholstery.

In the region of the recess 7, two pipe lengths 8 and 9 are secured to the supporting plate 4 at a spacing from one another, for example by welding. In the illustrated example, the arrangement is such that the common axis 10 of the two pipe lengths 9, 8 is disposed at a slight inclination to the plane of the supporting plate 4.

The pipe lengths 8, 9 serve to mount a screw-threaded spindle 11 which is locked against axial displacement by means of lock washers 12, 13.

In the region between the pipe lengths 8, 9, the spindle 11 carries a correspondingly screw-threaded nut 14 which, if it is prevented from rotating, can be displaced between the position 14*a* shown in full lines in FIG. 1 in abutment with the pipe length 8 and the position 14*b* shown in broken lines in abutment with the pipe length 9 by turning the hand wheel 15 secured to the front end of the screw-threaded spindle 11.

At the top, the nut 14 carries a transverse rod 16 which is rigidly secured to it such as by welding. This transverse rod 16 serves as a carrier for an intermediate plate 17 which is particularly clearly shown in FIG. 2 and which supports the seat upholstery 5 in the region of the recess 7. Between the intermediate plate 17 and the supporting plate 4 there is thus formed a wedge-shaped gap 18 which is open towards the front edge 6 of the seat upholstery 5.

The intermediate plate 17 comprises three sections, namely a front section 19 which, in the full-line FIG. 1 position of the intermediate plate 17 nearest the supporting plate 4 extends substantially parallel to the supporting plate. This front section 19 is adjoined by a central section 20 which extends obliquely to the supporting plate 4. Finally, the intermediate plate 17 also comprises an end section 21 which extends parallel to the front section 19 and thus, in the full-line position of FIG. 1, also parallel to the supporting plate 4 and even lies against same.

In the region of its rear edge 22, the intermediate plate 17 is pivoted to the supporting plate 4 so that, on displacement of the nut 14 from the position 14*a* to the position 14*b*, it can be shifted between the positions 17*a* (in full lines in FIG. 1) and 17*b* (in broken lines in FIG. 1), the result being that the upper surface 23 of the seat upholstery 5 will likewise be adjusted in the front region between the full line position and the broken line position of FIG. 1, whereby the angle of inclination of the upper surface 23 of the seat upholstery can be changed by the angle $\alpha$.

For the purpose of the pivotal mounting, the intermediate plate 17 has at its rear edge two angle members 24 which pass through transverse slots 25 in a cross-member 26. The angle members 24 each comprise a first limb 27 which extends the end section 21 of the intermediate plate and, adjoining same, a second limb 28 which projects upwardly substantially perpendicular to the supporting plate 4.

The cross-member 26 is formed by one limb of an angle section 29 of which the other limb 30 serves to fix the angle section 29 to the supporting plate 4, which can, for example, be effected by welding, screws or the like.

For assembly, the limbs 28 of the angle members 24 of the intermediate plate 17 are merely passed through the transverse slots 25 of the cross-member 26 and the intermediate plate 17 is then swung downwardly to its position of use where the central section 20 rests on the transverse rod 16.

Figure 2:
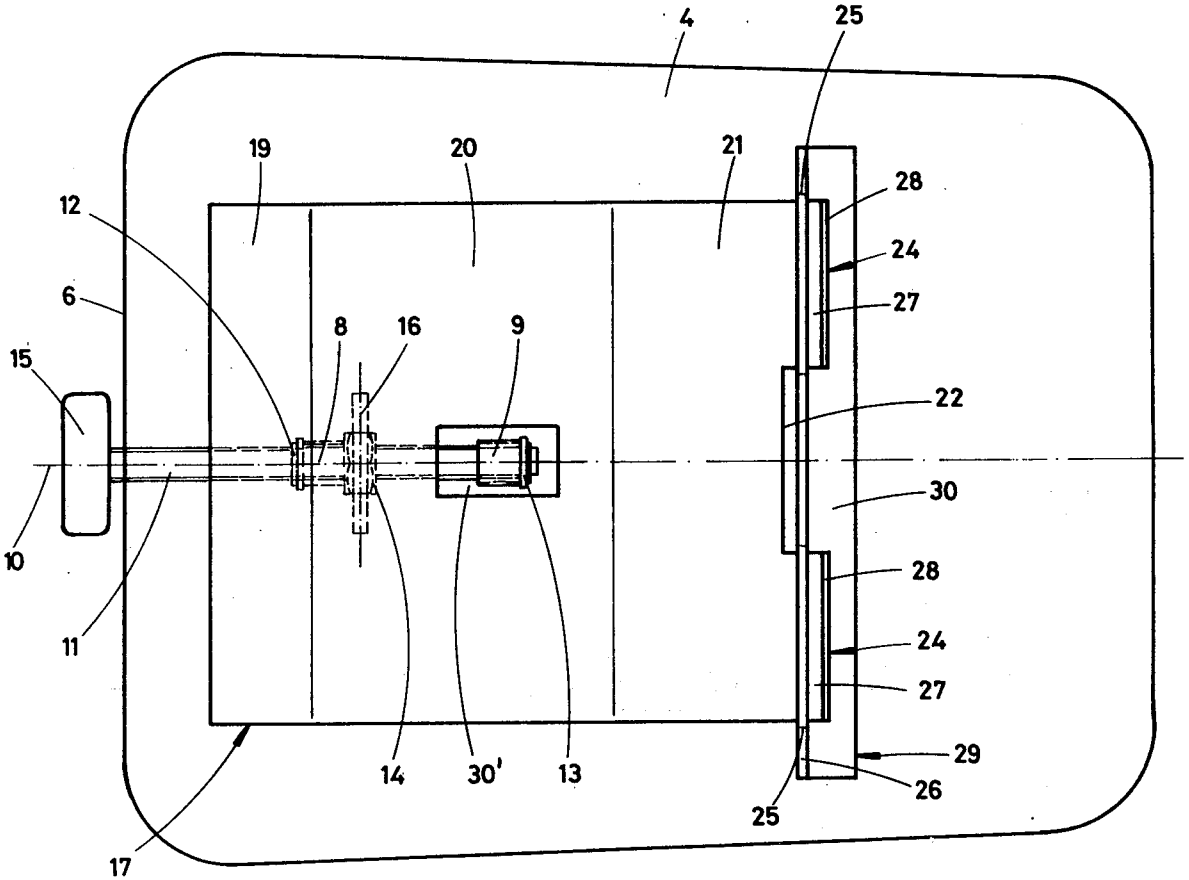
FIG. 2 is a plan view on the supporting plate, intermediate plate and adjusting apparatus of the seat according to FIG. 1 after the seat upholstery has been removed.

FIG. 2 also shows that the intermediate plate 17 has a recess 30' in the region of the pipe length 9 and the securing washer 13, whereby the structural height of the inclination adjusting apparatus can be further reduced because otherwise the intermediate plate 17 would not be able to assume the position 17*a* of FIG. 1.

Operation of the apparatus for adjusting the inclination of the seat upholstery is very simple. It is merely necessary to turn the hand wheel 15 appropriately, whereby the nut 14 is displaced axially along the spindle 11 and the transverse rod 16 moves along the central section 20 of the intermediate plate 17 so that the intermediate plate 17 is raised out of the position 17*a* or lowered out of the position 17*b*.

We claim:

1. An apparatus for adjusting the inclination of seat upholstery arranged on a supporting plate for a driver's seat, office chair, revolving armchair or the like comprising: an intermediate plate on which at least the front region of the said seat upholstery rests, said intermediate plate being mounted on the said supporting plate for pivoting movement about a transverse axis and being angularly disposed with respect to the said supporting plate to define a wedge-shaped gap with increasing height towards the front of the said seat upholstery; a carrier operatively engaging said intermediate plate; and means mounting said carrier for movement between the said supporting plate and said intermediate plate, the spacing of said carrier from the transverse axis being variable and the spacing of said carrier from the said supporting plate being substantially constant, whereby the intermediate plate is adjustable about said transverse axis.

2. The apparatus defined in claim 1, wherein the said carrier is a transverse rod.

3. The apparatus defined in claim 1, wherein the said means mounting said carrier comprises: a screw-threaded spindle mounted on said supporting plate, said spindle extending perpendicular to the said transverse axis and being rotatable but axially undisplaceable; a nut mounted on said spindle, said carrier being secured to said nut; and an actuating member mounted on said spindle.

4. The apparatus defined in claim 3, wherein the said means mounting said carrier further comprises two lengths of tube secured to the said supporting plate at the ends of the displacement path required for the said nut, said spindle extending through said tubes and being rotatably mounted therein, and a plurality of lockwashers, the said spindle being locked against axial displacement by means of said lock washers.

5. The apparatus defined in claim 3, wherein the said screw-threaded spindle projects beyond the front edge of the said supporting plate and said actuating member is a hand wheel mounted to said spindle beyond the front edge of said supporting plate.

6. An apparatus for adjusting the inclination of seat upholstery arranged on a supporting plate for a driver's seat, office chair, revolving armchair or the like, comprising:

an intermediate plate on which at least the front region of said seat upholstery rests, said intermediate plate being provided with at least one angle member projecting beyond its rear edge, said at least one angle member having a width less than that of said intermediate plate and comprising a first limb extending substantially as a prolongation of the said intermediate plate and a second limb extending from the said first limb;

means mounting said intermediate plate on said supporting plate for pivoting movement about a transverse axis, said intermediate plate being angularly disposed with respect to said supporting plate to define a wedge-shaped opening with increasing height towards the front of said seat upholstery, said means mounting said intermediate plate including a cross-member having a transverse slot mounted on the said supporting plate substantially parallel to the second limb, the first limb of said at least one angle member passing through the said transverse slot and being disposed adjacent said supporting plate, and the said second limb of said at least one angle member being disposed on the side of the said cross-member remote from the said intermediate plate and extending away from said supporting plate;

a carrier operatively engaging said intermediate; and means mounting said carrier for movement between said supporting plate and said intermediate plate, the spacing of said carrier from the transverse axis being variable and the spacing of said carrier from said supporting plate being substantially constant, whereby the intermediate plate is adjustable about said transverse axis.

7. The apparatus defined in claim 6, wherein the said intermediate plate carries two spaced angle members adjoining the side edges of the said intermediate plate.

8. The apparatus defined in claim 6, wherein said at least one angle member is formed on the said intermediate plate.

9. The apparatus defined in claim 6, wherein the said cross-member is formed by one limb of an angle section secured to the said supporting plate by its other limb.

10. The apparatus defined in claim 1, wherein the said intermediate plate comprises a front section adjoining the front edge of the said intermediate plate and substantially parallel to the said supporting plate in the position of smallest inclination, and a middle section adjoining the said front section and extending obliquely towards the said transverse axis of the said supporting plate.

11. The apparatus defined in claim 10, wherein the middle section of the said intermediate plate is adjoined by an end section which extends substantially parallel to the said front section and in the region of which the said transverse axis is provided.

12. The apparatus defined in claim 1, wherein the said intermediate plate, the said carrier and the means mounting said carrier for movement are accomodated in a recess in the underside of the said seat upholstery.

* * * * *

UNITED STATES PATENT AND TRADEMARK OFFICE

CERTIFICATE OF CORRECTION

PATENT NO. : 4,153,294

DATED : May 8, 1979

INVENTOR(S) : Hermann Meiller et al

It is certified that error appears in the above-identified patent and that said Letters Patent are hereby corrected as shown below:

Column 6, line 57, "accomodated" should be --accommodated--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*